United States Patent [19]

Usui

[11] Patent Number: 4,504,829

[45] Date of Patent: Mar. 12, 1985

[54] ELECTRONIC EQUIPMENT

[75] Inventor: Minoru Usui, Tokyo, Japan

[73] Assignee: Casio Computer Co., Ltd., Tokyo, Japan

[21] Appl. No.: 328,474

[22] Filed: Dec. 8, 1981

[30] Foreign Application Priority Data

Dec. 16, 1980 [JP] Japan ..... 55-177511
Dec. 16, 1980 [JP] Japan ..... 55-177513
Dec. 16, 1980 [JP] Japan ..... 55-177516

[51] Int. Cl.[3] ..... G09G 3/36

[52] U.S. Cl. ..... 340/756; 340/752; 340/765; 364/710

[58] Field of Search ..... 340/752, 756, 765, 790, 340/791, 731, 735; 364/710

[56] References Cited

U.S. PATENT DOCUMENTS 3,786,480 1/1974 Hatano et al. ..... 340/756 X
3,987,290 10/1976 Dickinson ..... 364/710
4,298,865 11/1981 Masuzawa et al. ..... 364/710 X
4,308,534 12/1981 Yamamoto ..... 340/752 X
4,388,696 6/1983 Test et al. ..... 364/710 X

FOREIGN PATENT DOCUMENTS 2062908 5/1981 United Kingdom .

OTHER PUBLICATIONS

Code-Umsetzer für Sieben-Segment-Zifferndarstellung, Elektronik, 1970 Heft 10, pp. 339-342.

*Primary Examiner*—David L. Trafton
*Attorney, Agent, or Firm*—Frishauf, Holtz, Goodman & Woodward

[57] ABSTRACT

Electronic equipment has a memory which stores input data to be displayed. The data read out from the memory is formed as a corresponding character pattern signal and is output from a character pattern generator. The character pattern signal generated by the character pattern generator is displayed in n characters at a display section in response to a first mode signal which is supplied by a mode switching section. The mode switching section supplies different display mode signals determined by the contents of the data to be displayed. The character pattern signal from the character pattern generator is displayed in m characters (n<m) at the display section in response to a second mode signal supplied by the mode switching section.

5 Claims, 23 Drawing Figures

FIG. 6

| A1 | A2 | A3 | A4 | A5 | A6 | A7 | A8 | O1 | O2 | O3 | O4 | O5 | O6 |
|---|---|---|---|---|---|---|---|---|---|---|---|---|---|
| 0 | 0 | 0 | 1 | 0 | 0 | 0 | 0 | 0 | 0 | 1 | 0 | 0 | 0 |
| | | | | | 0 | 0 | 1 | 0 | 1 | 1 | 0 | 0 | 0 |
| | | | | | 0 | 1 | 0 | 0 | 0 | 1 | 0 | 0 | 0 |
| | | | | | 0 | 1 | 1 | 0 | 0 | 1 | 0 | 0 | 0 |
| | | | | | 1 | 0 | 0 | 0 | 0 | 1 | 0 | 0 | 0 |
| | | | | | 1 | 0 | 1 | 0 | 0 | 1 | 0 | 0 | 0 |
| 0 | 0 | 0 | 1 | 0 | 1 | 1 | 0 | 0 | 1 | 1 | 1 | 0 | 0 |
| 0 | 0 | 1 | 0 | 0 | 0 | 0 | 0 | 0 | 1 | 1 | 1 | 0 | 0 |
| | | | | | 0 | 0 | 1 | 1 | 0 | 0 | 0 | 1 | 0 |
| | | | | | 0 | 1 | 0 | 1 | 0 | 0 | 0 | 1 | 0 |
| | | | | | 0 | 1 | 1 | 0 | 0 | 0 | 1 | 0 | 0 |
| | | | | | 1 | 0 | 0 | 0 | 0 | 1 | 0 | 0 | 0 |
| | | | | | 1 | 0 | 1 | 0 | 1 | 0 | 0 | 0 | 0 |
| 0 | 0 | 1 | 0 | 0 | 1 | 1 | 0 | 1 | 1 | 1 | 1 | 1 | 0 |
| 0 | 0 | 1 | 1 | 0 | 0 | 0 | 0 | 0 | 1 | 1 | 1 | 0 | 0 |
| | | | | | 0 | 0 | 1 | 1 | 0 | 0 | 0 | 1 | 0 |
| | | | | | 0 | 1 | 0 | 0 | 0 | 0 | 0 | 1 | 0 |
| | | | | | 0 | 1 | 1 | 0 | 0 | 1 | 1 | 0 | 0 |
| | | | | | 1 | 0 | 0 | 0 | 0 | 0 | 0 | 1 | 0 |
| | | | | | 1 | 0 | 1 | 1 | 0 | 0 | 0 | 1 | 0 |
| 0 | 0 | 1 | 1 | 0 | 1 | 1 | 0 | 0 | 1 | 1 | 1 | 0 | 0 |
| 0 | 1 | 0 | 0 | 0 | 0 | 0 | 0 | 0 | 0 | 1 | 1 | 0 | 0 |
| | | | | | 0 | 0 | 1 | 0 | 1 | 0 | 1 | 0 | 0 |
| | | | | | 0 | 1 | 0 | 1 | 0 | 0 | 1 | 0 | 0 |
| | | | | | 0 | 1 | 1 | 1 | 0 | 0 | 1 | 0 | 0 |
| | | | | | 1 | 0 | 0 | 1 | 1 | 1 | 1 | 1 | 0 |
| | | | | | 1 | 0 | 1 | 0 | 0 | 0 | 1 | 0 | 0 |
| 0 | 1 | 0 | 0 | 0 | 1 | 1 | 0 | 0 | 0 | 0 | 1 | 0 | 0 |

FIG. 7

| A1 | A2 | A3 | A4 | A5 | A6 | A7 | A8 | 01 | 02 | 03 | 04 | 05 | 06 |
|---|---|---|---|---|---|---|---|---|---|---|---|---|---|
| 0 | 0 | 0 | 1 | 1 | 0 | 0 | 0 | 0 | 0 | 0 | 0 | 0 | 0 |
| | | | | | 0 | 0 | 1 | | | | 0 | 1 | 0 |
| | | | | | 0 | 1 | 0 | | | | 0 | 1 | 0 |
| | | | | | 0 | 1 | 1 | | | | 0 | 1 | 0 |
| | | | | | 1 | 0 | 0 | | | | 0 | 1 | 0 |
| | | | | | 1 | 0 | 1 | | | | 0 | 1 | 0 |
| 0 | 0 | 0 | 1 | 1 | 1 | 1 | 0 | 0 | 0 | 0 | 0 | 0 | 0 |
| 0 | 0 | 1 | 0 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 1 | 1 | 1 |
| | | | | | 1 | 0 | 0 | | | | 1 | 0 | 0 |
| | | | | | 1 | 0 | 1 | | | | 1 | 1 | 1 |
| 0 | 0 | 1 | 0 | 1 | 1 | 1 | 0 | 0 | 0 | 0 | 0 | 0 | 0 |
| 0 | 0 | 1 | 1 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 0 | 1 | 1 |
| | | | | | 1 | 0 | 0 | | | | 0 | 0 | 1 |
| | | | | | 1 | 0 | 1 | | | | 1 | 1 | 1 |
| 0 | 0 | 1 | 1 | 1 | 1 | 1 | 0 | 0 | 0 | 0 | 0 | 0 | 0 |
| 0 | 1 | 0 | 0 | 1 | 0 | 0 | 0 | 0 | 0 | 0 | 0 | 0 | 0 |
| | | | | | 0 | 0 | 1 | | | | 1 | 0 | 1 |
| | | | | | 0 | 1 | 0 | | | | 1 | 0 | 1 |
| | | | | | 0 | 1 | 1 | | | | 1 | 1 | 1 |
| | | | | | 1 | 0 | 0 | | | | 0 | 0 | 1 |
| | | | | | 1 | 0 | 1 | | | | 0 | 0 | 1 |
| 0 | 1 | 0 | 0 | 1 | 1 | 1 | 0 | 0 | 0 | 0 | 0 | 0 | 0 |

FIG. 11

| A1 | A2 | A3 | A4 | A5 | A6 | A7 | A8 | 01 | 02 | 03 | 04 | 05 | 06 |
|---|---|---|---|---|---|---|---|---|---|---|---|---|---|
| 0 | 0 | 0 | 1 | 0 | 0 | 0 | 0 | 0 | 0 | 1 | 0 | 0 | 0 |
| | | | | | 0 | 0 | 1 | 0 | 1 | 1 | 0 | 0 | 0 |
| | | | | | 0 | 1 | 0 | 0 | 0 | 1 | 0 | 0 | 0 |
| | | | | | 0 | 1 | 1 | 0 | 0 | 1 | 0 | 0 | 0 |
| | | | | | 1 | 0 | 0 | 0 | 0 | 1 | 0 | 0 | 0 |
| | | | | | 1 | 0 | 1 | 0 | 0 | 1 | 0 | 0 | 0 |
| 0 | 0 | 0 | 1 | 0 | 1 | 1 | 0 | 0 | 1 | 1 | 1 | 0 | 0 |
| 0 | 0 | 1 | 0 | 0 | 0 | 0 | 0 | 0 | 1 | 1 | 1 | 0 | 0 |
| | | | | | 0 | 0 | 1 | 1 | 0 | 0 | 0 | 1 | 0 |
| | | | | | 0 | 1 | 0 | 1 | 0 | 0 | 0 | 1 | 0 |
| | | | | | 0 | 1 | 1 | 0 | 0 | 0 | 1 | 0 | 0 |
| | | | | | 1 | 0 | 0 | 0 | 0 | 1 | 0 | 0 | 0 |
| | | | | | 1 | 0 | 1 | 0 | 1 | 0 | 0 | 0 | 0 |
| 0 | 0 | 1 | 0 | 0 | 1 | 1 | 0 | 1 | 1 | 1 | 1 | 1 | 0 |
| 0 | 0 | 1 | 1 | 0 | 0 | 0 | 0 | 0 | 1 | 1 | 1 | 0 | 0 |
| | | | | | 0 | 0 | 1 | 1 | 0 | 0 | 0 | 1 | 0 |
| | | | | | 0 | 1 | 0 | 0 | 0 | 0 | 0 | 1 | 0 |
| | | | | | 0 | 1 | 1 | 0 | 0 | 1 | 1 | 0 | 0 |
| | | | | | 1 | 0 | 0 | 0 | 0 | 0 | 0 | 1 | 0 |
| | | | | | 1 | 0 | 1 | 1 | 0 | 0 | 0 | 1 | 0 |
| 0 | 0 | 1 | 1 | 0 | 1 | 1 | 0 | 0 | 1 | 1 | 1 | 0 | 0 |
| 0 | 1 | 0 | 0 | 0 | 0 | 0 | 0 | 0 | 0 | 1 | 1 | 0 | 0 |
| | | | | | 0 | 0 | 1 | 0 | 1 | 0 | 1 | 0 | 0 |
| | | | | | 0 | 1 | 0 | 1 | 0 | 0 | 1 | 0 | 0 |
| | | | | | 0 | 1 | 1 | 1 | 0 | 0 | 1 | 0 | 0 |
| | | | | | 1 | 0 | 0 | 1 | 1 | 1 | 1 | 1 | 0 |
| | | | | | 1 | 0 | 1 | 0 | 0 | 0 | 1 | 0 | 0 |
| 0 | 1 | 0 | 0 | 0 | 1 | 1 | 0 | 0 | 0 | 0 | 1 | 0 | 0 |

FIG. 12

| A1 | A2 | A3 | A4 | A5 | A6 | A7 | A8 | 01 | 02 | 03 | 04 | 05 | 06 |
|---|---|---|---|---|---|---|---|---|---|---|---|---|---|
| 0 | 0 | 0 | 1 | 1 | 0 | 0 | 0 | 0 | 0 | 0 | 0 | 0 | 0 |
| | | | | | 0 | 0 | 1 | | | | 0 | 1 | 0 |
| | | | | | 0 | 1 | 0 | | | | 0 | 1 | 0 |
| | | | | | 0 | 1 | 1 | | | | 0 | 1 | 0 |
| | | | | | 1 | 0 | 0 | | | | 0 | 1 | 0 |
| | | | | | 1 | 0 | 1 | | | | 0 | 1 | 0 |
| 0 | 0 | 0 | 1 | 1 | 1 | 1 | 0 | 0 | 0 | 0 | 0 | 0 | 0 |
| 0 | 0 | 1 | 0 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 1 | 1 | 1 |
| | | | | | 1 | 0 | 0 | | | | 1 | 0 | 0 |
| | | | | | 1 | 0 | 1 | | | | 1 | 1 | 1 |
| 0 | 0 | 1 | 0 | 1 | 1 | 1 | 0 | 0 | 0 | 0 | 0 | 0 | 0 |
| 0 | 0 | 1 | 1 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 0 | 1 | 1 |
| | | | | | 1 | 0 | 0 | | | | 0 | 0 | 1 |
| | | | | | 1 | 0 | 1 | | | | 1 | 1 | 1 |
| 0 | 0 | 1 | 1 | 1 | 1 | 1 | 0 | 0 | 0 | 0 | 0 | 0 | 0 |
| 0 | 1 | 0 | 0 | 1 | 0 | 0 | 0 | 0 | 0 | 0 | 0 | 0 | 0 |
| | | | | | 0 | 0 | 1 | | | | 1 | 0 | 1 |
| | | | | | 0 | 1 | 0 | | | | 1 | 0 | 1 |
| | | | | | 0 | 1 | 1 | | | | 1 | 1 | 1 |
| | | | | | 1 | 0 | 0 | | | | 0 | 0 | 1 |
| | | | | | 1 | 0 | 1 | | | | 0 | 0 | 1 |
| 0 | 1 | 0 | 0 | 1 | 1 | 1 | 0 | 0 | 0 | 0 | 0 | 0 | 0 |

FIG. 17

| A1 | A2 | A3 | A4 | A5 | A6 | A7 | A8 | 01 | 02 | 03 | 04 | 05 | 06 |
|---|---|---|---|---|---|---|---|---|---|---|---|---|---|
| 0 | 0 | 0 | 1 | 0 | 0 | 0 | 0 | 0 | 0 | (1) | 0 | 0 | 0 |
| | | | | | 0 | 0 | 1 | 0 | (1) | (1) | 0 | 0 | 0 |
| | | | | | 0 | 1 | 0 | 0 | 0 | (1) | 0 | 0 | 0 |
| | | | | | 0 | 1 | 1 | 0 | 0 | (1) | 0 | 0 | 0 |
| | | | | | 1 | 0 | 0 | 0 | 0 | (1) | 0 | 0 | 0 |
| | | | | | 1 | 0 | 1 | 0 | 0 | (1) | 0 | 0 | 0 |
| 0 | 0 | 0 | 1 | 0 | 1 | 1 | 0 | 0 | (1) | (1) | (1) | 0 | 0 |
| 0 | 0 | 1 | 0 | 0 | 0 | 0 | 0 | 0 | (1) | (1) | (1) | 0 | 0 |
| | | | | | 0 | 0 | 1 | (1) | 0 | 0 | 0 | (1) | 0 |
| | | | | | 0 | 1 | 0 | (1) | 0 | 0 | 0 | (1) | 0 |
| | | | | | 0 | 1 | 1 | 0 | 0 | 0 | (1) | 0 | 0 |
| | | | | | 1 | 0 | 0 | 0 | 0 | (1) | 0 | 0 | 0 |
| | | | | | 1 | 0 | 1 | 0 | (1) | 0 | 0 | 0 | 0 |
| 0 | 0 | 1 | 0 | 0 | 1 | 1 | 0 | (1) | (1) | (1) | (1) | (1) | 0 |
| 0 | 0 | 1 | 1 | 0 | 0 | 0 | 0 | 0 | (1) | (1) | (1) | 0 | 0 |
| | | | | | 0 | 0 | 1 | (1) | 0 | 0 | 0 | (1) | 0 |
| | | | | | 0 | 1 | 0 | 0 | 0 | 0 | 0 | (1) | 0 |
| | | | | | 0 | 1 | 1 | 0 | 0 | (1) | (1) | 0 | 0 |
| | | | | | 1 | 0 | 1 | 0 | 0 | 0 | 0 | (1) | 0 |
| | | | | | 1 | 0 | 1 | (1) | 0 | 0 | 0 | (1) | 0 |
| 0 | 0 | 1 | 1 | 0 | 1 | 1 | 0 | 0 | (1) | (1) | (1) | 0 | 0 |
| 0 | 1 | 0 | 0 | 0 | 0 | 0 | 0 | 0 | 0 | (1) | (1) | 0 | 0 |
| | | | | | 0 | 0 | 1 | 0 | (1) | 0 | (1) | 0 | 0 |
| | | | | | 0 | 1 | 0 | (1) | 0 | 0 | (1) | 0 | 0 |
| | | | | | 0 | 1 | 1 | (1) | 0 | 0 | (1) | 0 | 0 |
| | | | | | 1 | 0 | 0 | (1) | (1) | (1) | (1) | (1) | 0 |
| | | | | | 1 | 0 | 1 | 0 | 0 | 0 | (1) | 0 | 0 |
| 0 | 1 | 0 | 0 | 0 | 1 | 1 | 0 | 0 | 0 | 0 | (1) | 0 | 0 |

FIG. 18

| A1 | A2 | A3 | A4 | A5 | A6 | A7 | A8 | O1 | O2 | O3 | O4 | O5 | O6 |
|---|---|---|---|---|---|---|---|---|---|---|---|---|---|
| 0 | 0 | 0 | 1 | 1 | 0 | 0 | 0 | 0 | 0 | 0 | 0 | 0 | 0 |
| | | | | | 0 | 0 | 1 | | | | 0 | 1 | 0 |
| | | | | | 0 | 1 | 0 | | | | 0 | 1 | 0 |
| | | | | | 0 | 1 | 1 | | | | 0 | 1 | 0 |
| | | | | | 1 | 0 | 0 | | | | 0 | 1 | 0 |
| | | | | | 1 | 0 | 1 | | | | 0 | 1 | 0 |
| 0 | 0 | 0 | 1 | 1 | 1 | 1 | 0 | 0 | 0 | 0 | 0 | 0 | 0 |
| 0 | 0 | 1 | 0 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 1 | 1 | 1 |
| | | | | | 1 | 0 | 0 | | | | 1 | 0 | 0 |
| | | | | | 1 | 0 | 1 | | | | 1 | 1 | 1 |
| 0 | 0 | 1 | 0 | 1 | 1 | 1 | 0 | 0 | 0 | 0 | 0 | 0 | 0 |
| 0 | 0 | 1 | 1 | 1 | 0 | 0 | 0 | 0 | 0 | 0 | 0 | 0 | 0 |
| | | | | | 0 | 0 | 1 | | | | 1 | 1 | 1 |
| | | | | | 0 | 1 | 0 | | | | 0 | 0 | 1 |
| | | | | | 0 | 1 | 1 | | | | 0 | 1 | 1 |
| | | | | | 1 | 0 | 0 | | | | 0 | 0 | 1 |
| | | | | | 1 | 0 | 1 | | | | 1 | 1 | 1 |
| 0 | 0 | 1 | 1 | 1 | 1 | 1 | 0 | 0 | 0 | 0 | 0 | 0 | 0 |
| 0 | 1 | 0 | 0 | 1 | 0 | 0 | 0 | 0 | 0 | 0 | 0 | 0 | 0 |
| | | | | | 0 | 0 | 1 | | | | 1 | 0 | 1 |
| | | | | | 0 | 1 | 0 | | | | 1 | 0 | 1 |
| | | | | | 0 | 1 | 1 | | | | 1 | 1 | 1 |
| | | | | | 1 | 0 | 0 | | | | 0 | 0 | 1 |
| | | | | | 1 | 0 | 1 | | | | 0 | 0 | 1 |
| 0 | 1 | 0 | 0 | 1 | 1 | 1 | 0 | 0 | 0 | 0 | 0 | 0 | 0 |

ELECTRONIC EQUIPMENT

BACKGROUND OF THE INVENTION

The present invention relates to electronic equipment which has a display section with a dot matrix display and, more particularly, to electronic equipment which selects the number of characters within the maximum number of characters to be displayed at the display section in accordance with the display data, and which displays the number of selected characters.

In electronic equipment such as an electronic portable calculator, data which is entered at a key input section and calculated within a CPU, comprising the number of characters to be displayed at the display section, has conventionally been limited to data comprising 8, 10 or 12 characters. Therefore, when data such as a first operand and a second operand comprising 9 or more characters is input to an electronic portable calculator which displays 8 characters at maximum, input data is regarded as an error, disabling the operation. Further, when an operand result exceeds 8 characters, the operation is regarded as an error. Therefore, proper display cannot be accomplished. In this case, when an operation involving 10 or 12 characters is to be performed, another electronic portable calculator which is capable of displaying 10 or 12 characters must be purchased.

In exponential display, for example, data which exceeds the capacity of the number of characters to be displayed is entered at the key input section. When data comprising 8 characters such as "12345678" is input, this data is displayed in the manner as shown in FIG. 1A. However, when the exponential display is to be performed, a significant figure part, a blank part and an exponent part are simultaneously displayed within the range of 8 characters. As shown in FIG. 1B, the significant figure part comprises 5 characters such as "1.2345", the blank part comprises one character space, and the exponent part comprises 2 characters such as "10". Therefore, when the significant figure part comprises 6 characters or more, characters in excess of 5 characters are not displayed. For this reason, the number of characters at the display section must be increased.

However, when the number of characters to be displayed increases, including the case as described above, the display section must accordingly increase, resulting in an increase in manufacturing cost of the electronic equipment. Further, operations involving 9 characters or more are infrequently performed, so that an electronic portable calculator which displays 9 characters or more is rarely used to full display capacity, resulting in uneconomical operation.

SUMMARY OF THE INVENTION

It is an object of the present invention to eliminate the drawbacks as described above and to provide electronic equipment which selects the number of characters to be displayed as needed in accordance with the display data, and which displays the selected number of characters.

In order to achieve the above and other objects of the present invention, there is provided electronic equipment comprising memory means for storing input data to be displayed; character pattern signal generating means, connected to said memory means, for generating a character pattern signal corresponding to the input data to be displayed; display means, which has a display section in which a plurality of dot display elements are aligned in a matrix form, for displaying the data which is stored in said memory means in response to the character pattern signal from said character pattern signal generating means; mode signal generating means for generating different first and second mode signals in response to a display mode of the data to be displayed by said display means; and display control means for displaying the data which is stored in said memory means in n characters in response to the first mode signal which is generated by said mode signal generating means, and for displaying the data which is stored in said memory means in m characters ($n<m$) in response to the second mode signal.

According to the electronic equipment with the above arrangement of the present invention, a display mode is selected in accordance with the number of characters of the data to be displayed at the display section, and the number of characters to be displayed at the display section may increase or decrease, so that the data which is entered at the key input section, such as the first operand or the second operand, and data which is calculated within the CPU, may effectively be displayed, especially in an operation which involves scientific notation.

BRIEF DESCRIPTION OF THE DRAWINGS

FIGS. 6 and 7 are views illustrating part of the storage condition of a ROM which constitutes a character pattern generator in the different display modes, respectively;

FIGS. 11 and 12 are views for explaining the part of the storage condition of a ROM which constitutes the character pattern generator in the different modes, respectively;

FIGS. 17 and 18 are views for explaining the storage condition of a ROM which constitutes the character pattern generator in the different display modes, respectively.

DETAILED DESCRIPTION OF THE PREFERRED EMBODIMENTS

Figure 1A:
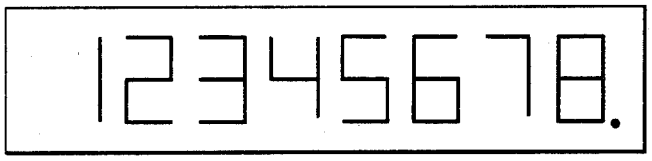
FIG. 1A is a view for explaining the display condition of 8 characters at a display section of conventional electronic equipment.
Figure 1B:
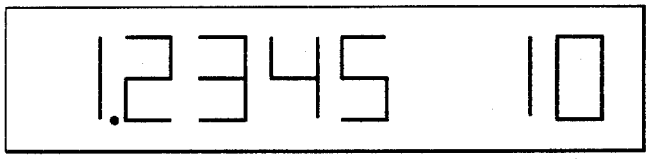
FIG. 1B is a view for explaining the display condition in which exponential display within 8 characters of FIG. 1 is performed.
Figure 2:
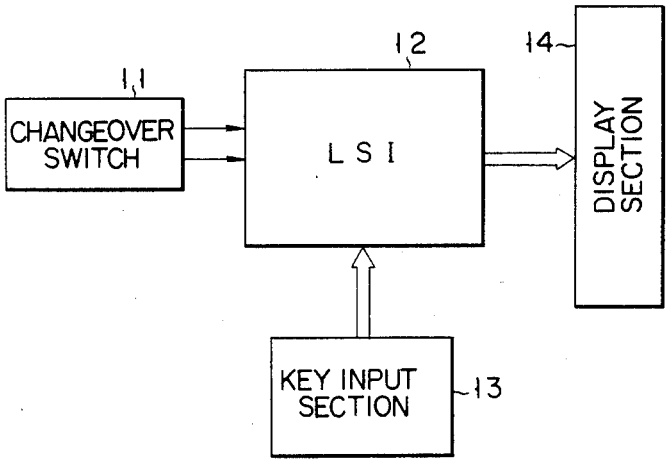
FIG. 2 is a block circuit diagram illustrating the schematic arrangement of an electronic portable calculator according to one embodiment of the present invention.

One embodiment of the present invention will be described with reference to the accompanying drawings. FIG. 2 shows a schematic block circuit diagram of an electronic portable calculator to be described in detail later with reference to FIG. 3. A changeover switch 11 comprises, for example, a slide switch, as shown in the figure. An operation signal from the changeover switch 11 is transmitted to an LSI (Large Scale Integrated Circuit) 12. The LSI 12, which comprises an operation circuit, a display control circuit and so on, performs a predetermined operation based on predetermined input data such as a first operand and a second operand. Data which is entered at a key input section 13 or data which is calculated in the LSI 12 is supplied to a display section 14 and is displayed at the display section 14. A changeover pattern which is displayed at the display section 14 is selected by the changeover switch 11.

Figure 3:
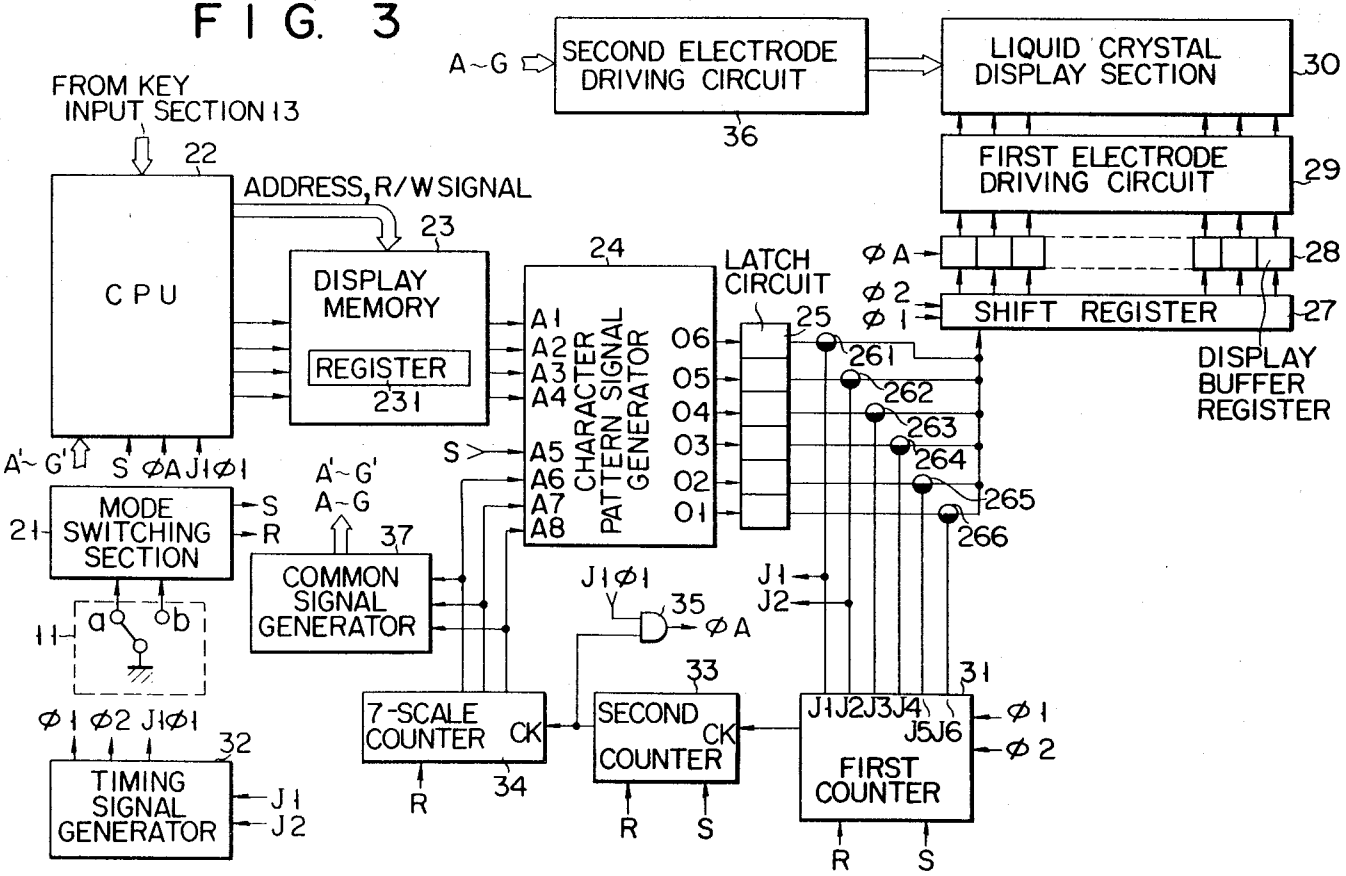
FIG. 3 is a block circuit diagram illustrating the detailed arrangement of the circuit of FIG. 2.
Figure 5:
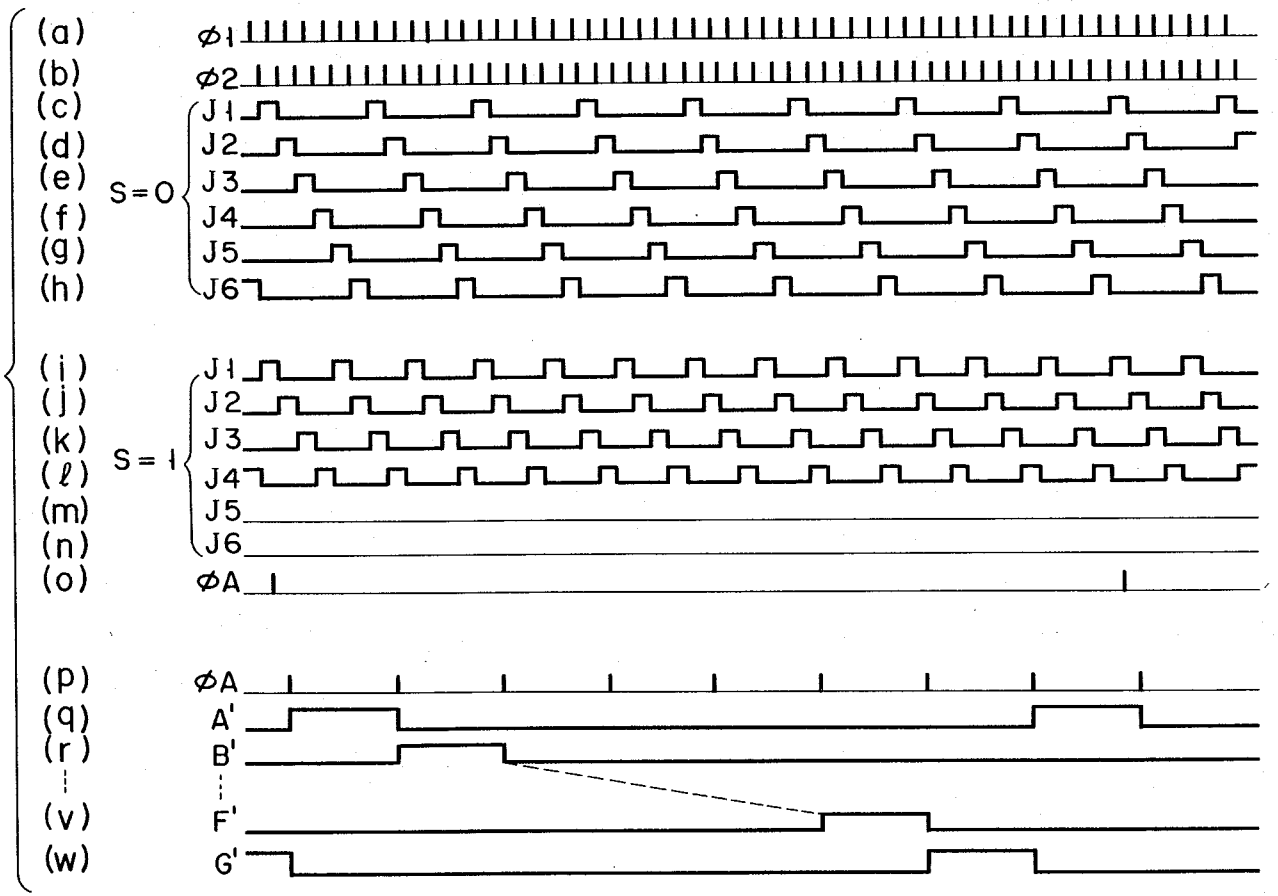
FIG. 5 shows timing charts of respective signals for explaining the modes of operation of the circuit of FIG. 3.

FIG. 3 shows the overall arrangement of the electronic portable calculator as described above. In the figure, the changeover switch 11 transmits the operation signal to a mode switching section 21. When the changeover switch 11 is set at a constant a, the mode switching section 21 supplies a binary coded signal "0" as a mode signal S to each control section. On the other hand, when the changeover switch 11 is set at a contact b, the mode switching section 21 supplies a binary coded signal "1" as the mode signal S to each control section. Furthermore, immediately after the changeover switch 11 is set to the contact a from the contact b or to the contact b from the contact a, the mode switching section 21 supplies a reset signal R to each control section. The data which is entered at the key input section 13 is transmitted to a CPU (Central Processing Unit) 22. The mode signal S as described above is also input to the CPU 22. The CPU 22 supplies the data which is entered at the key input section 13, or an operated result within the CPU 22 based on the above data, to display register 231 or 12 character positions within a display memory 23 through four signal lines. Further, the CPU 22 transmits a read/write signal and a character address designation signal to the display register 231. Data of 4 bits which is stored in a position of the display register 231 whose address is selected by the character address designation signal, is input to input terminals A1 to A4 of a character pattern generator 24. The character pattern generator 24 comprises, for example, a ROM (read-only memory) in which a 5×7 dot matrix pattern and a 3×5 dot matrix pattern are stored. Part of its configuration is described with reference to FIGS. 5 and 6 later on. An address signal which is input through input terminals A1 to A8 of the character pattern generator 24 specifies the character address so that the mode signal S which is supplied from the mode switching section 21 is input to the input terminal A5. When the signal "0" as the mode signal S is input, the address at which data of the 5×7 dot matrix pattern is stored is specified, and when the signal "1" is input as the mode signal S, the address at which data of the 3×5 dot matrix pattern is stored is specified. Data corresponding to one row of the dot pattern which is stored in the character pattern generator 24 is supplied through output terminals O1 to O6 to a latch circuit 25 which comprises 6 bits. Signal lines carrying signals output from each bit of the latch circuit 25 are connected to a shift register 27 through transfer gates 261 to 266. The shift register 27 is constituted by 48 bits. Signal lines for each bit are connected to a display buffer register 28. Data which is retained in the display buffer register 28 is supplied to a first electrode driving circuit 29. Further, based on the data which is retained in the display buffer register 28, the first electrode driving circuit 29 supplies a first electrode driving signal to a liquid crystal display section 30. Signals from lines "J1" to "J6" of a first counter 31 are supplied as gate control signals to the gates of the transfer gates 261 to 266. The mode signal S and the reset signal R are input from the mode switching section 21 to the first counter 31. When the first counter 31 receives the signal "0" as the mode signal S, the first counter 31 operates as a 6-scale counter. On the other hand, when the first counter 31 receives the signal "1" as the mode signal S, the first counter 31 operates as a 4-scale counter. Signals from the lines "J1" and "J2" of the first counter are input to a timing signal generator 32. A carry signal from the first counter 31 is supplied to a second counter 33. The second counter 33 receives the mode signal S and the reset signal R from the mode switching section 21. When the second counter 33 receives the signal "0" as the mode signal S, the second counter 33 operates as an 8-scale counter. On the other hand, when the second counter 33 receives the signal "1", the second counter 33 operates as a 12-scale counter. Further, the carry signal from the second counter 33 is output to a 7-scale counter 34 and an AND circuit 35. The AND circuit 35 receives a logical product, that is, a timing signal J1$\phi$1. A timing signal $\phi$A which is output from the AND circuit 35 is supplied as a read-in timing signal to the display buffer register 28 and the CPU 22. The reset signal R from the mode switching section 21 is input to the 7-scale counter 34. A counter value of the 7-scale counter 34 is supplied to the input terminals A6 to A8 of the character pattern generator 24 and to a common signal generator 37 through three signal lines. Common signals A to G which are generated from the common signal generator 37 are supplied to a second electrode driving circuit 36 and are sequentially supplied to rows "A" to "G" of the liquid crystal display section 30. The timing signal generator 32 supplies clock signals $\phi$1 and $\phi$2 to the shift register 27 and the first counter 31, and the timing signal J1$\phi$1 to the CPU 22, respectively.

The storage conditions of a ROM which constitutes the character pattern generator 24 are respectively shown in FIGS. 6 and 7. FIG. 6 shows the storage condition in which the 5×7 dot matrix pattern is stored. When the signal "0" as the mode signal S is input to the input terminal A5, data corresponding to one row of the character pattern which is stored in the area whose address is specified by signals which are input through input terminals A1 to A4 and A6 to A8, is output from the output terminals O1 to O6. Referring to FIG. 6, when binary coded data "0001" to "0100" are input from the input terminals A1 to A4, start addresses of the register in which character patterns of "1" to "4" are stored are selected. When data "000" to "110" are input from the input terminals A6 to A8, data corresponding to each row of the character patterns of "1" to "4" is output.

FIG. 7 shows the storage condition of the ROM in which the 3×5 dot matrix is stored. When the signal "1" as the mode signal S is input, data corresponding to one row of the character pattern which is stored in the area of the register whose address is specified by signals which are input from the input terminals A1 to A4 and A6 to A8, is supplied from the output terminals O1 to O6. Referring to FIG. 7, when binary coded data "0001" to "0100" are input from the input terminals A1 to A4, start addresses of the register in which character patterns of "1" to "4" are stored are specified. When data "000" to "110" are input from the input terminals A6 to A8, data corresponding to each row of the character patterns of "1" to "4" is output.

Figure 4A:
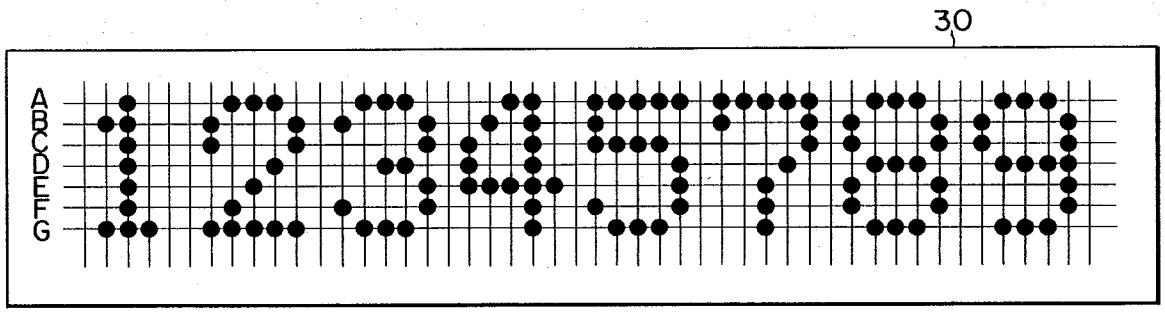
FIGS. 4A and 4B are views for explaining modes of operation in different display modes, respectively.

The mode of operation of the electronic portable calculator with the above arrangement will be described. An operation within 8 characters is first described. In this case, the changeover switch 11 is set at the contact a. The reset signal R is output from the mode switching section 21 to the first and second counters 31 and 33 and the 7-scale counter 34, so that the respective counters are reset. The signal "0" as the mode signal S is output from the mode switching section 21 to the CPU 22, the character pattern generator 24, and the first and second counters 31 and 33. Therefore, the CPU 22 is set in the condition in which the operation of up to 8 characters is ready to be performed. Signals are input to the input terminals A1 to A8 of the character pattern generator 24 so that data corresponding to one row of the 5×7 dot matrix pattern is specified. The first counter 31 operates as a 6-scale counter and the signal "1" is sequentially output from the lines "J1" to "J6", as shown in FIGS. 5C to 5H. Data comprising 8 charactes such as "12345789" is input to the display register 231 as data which is entered at the key input section 13 or data which is operated within the CPU 22. This data is then displayed at the liquid crystal display section 30. The mode of operation described above will be described in detail below. At a timing of a common signal A′ of FIG. 5Q immediately after the common signal A is generated, the address of a first position of the display register 231 is specified in response to the timing signal J1ϕ1, and data "9" ("1001") which is stored in the address of the display register 231 is supplied to the input terminals A1 to A4 of the character pattern generator 24. As a result, data "011100" of a first row, which is a dot signal to indicate the presence or absence of dots by the binary code "1" or "0", is latched in the latch circuit 25. Sequentially, addresses of the second to eighth positions of the display register 231 are selected, so that data "8" to "1" which are stored in the second to eighth positions of the display register 231 are sequentially supplied to the input terminals A1 to A4 of the character pattern generator 24. Data corresponding to the first row of the character pattern of the data "9" to "1" are supplied to the latch circuit 25. The data corresponding to the first row which is stored in the latch circuit 25 is sequentially converted to serial data and supplied to the shift register 27 through the transfer gates 261 to 266 which are sequentially rendered conductive. Data corresponding to first rows of the character patterns of data "9" to "1" which are stored in the latch circuit 25 are sequentially converted to serial data and are supplied to the shift register 27. When the data for each first row of each character pattern of the display data of 8 characters which are stored in the display register 231 is stored in the shift register 27, a carry signal from the second counter 33 is supplied to the 7-scale counter 34 and the AND circuit 35. The timing signal ϕA is supplied from the AND circuit 35 to the display buffer register 28. The data which is stored in the shift register 27 is retained in the display buffer register 28. The data which is retained in the display buffer register 28 is supplied to the first electrode driving circuit 29. Further, the first electrode driving circuit 29 supplies the first electrode driving signal to the liquid crystal display section 30, based on the data which is retained in the display buffer register 28. Therefore, the data is displayed at the liquid crystal display section 30. As a result, dots in the row A are displayed as shown in FIG. 4A. Subsequently, when the timing signal ϕA is supplied to the CPU 22, signals which select addresses of first to eighth positions of the display register 231 are output. In the same manner, at the timing of a common signal B′ of FIG. 5R, data corresponding to a second row of each character pattern which is stored in the display register 231 is stored in the shift register 27, so that dots in the row B are displayed as shown in FIG. 4A. At timings of common signals C′ to G′, every time the signal ϕA is sequentially supplied, data corresponding to the third to seventh rows of each character pattern of the display data which is stored in the display register 231, is stored in the shift register 27. Therefore, the display data "12345789" comprising 8 characters is displayed at the liquid crystal display section 30.

Figure 4B:
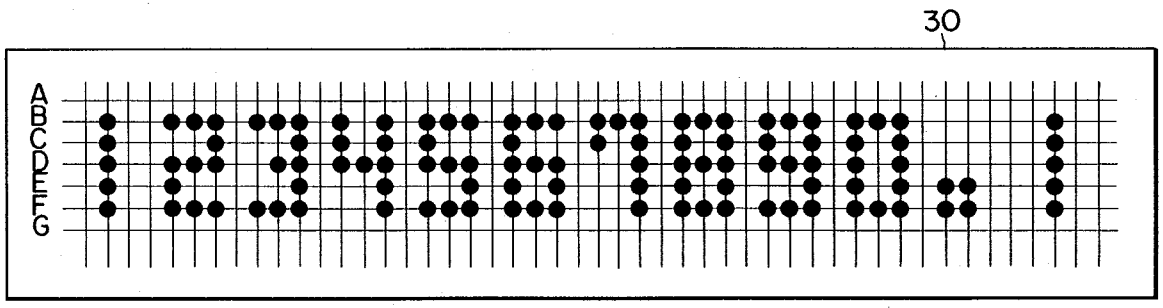

The operation for 12 characters will now be described. In this case, the changeover switch 11 is set at the contact b. The reset signal R is supplied from the mode switching section 21 to the first and second counters 31 and 33 and the 7-scale counter 34, so that the respective counters are reset. The signal "1" as the mode signal S is supplied from the mode switching section 21 to the CPU 22, the character pattern generator 24, and the first and second counters 31 and 33. Therefore, the electronic portable calculator is ready for the operation of 12 characters. Signals are supplied to the input terminals A1 to A4 and A6 to A8 of the character pattern generator 24, and data which corresponds to one row of the 3×5 dot matrix pattern is specified by the input signals. The first counter 31 operates as a 4-scale counter and sequentially supplies the signal "1" from the line "J1" to "J4", as shown in FIGS. 5I to 5L. The signal "0" is supplied from the lines "J5" and "J6" of the first counter 31. The operation is described in which display data of 12 characters, that is, data "1234567890.1", is supplied to the display register 231 as the data which is entered at the key input section 13 or the data which is operated within the CPU 22, and is displayed at the liquid crystal display section 30. At the timing of the common signal A′ of FIG. 5Q immediately before the common signal A is generated, an address for a first position of the display register 231 is specified in synchronism with the timing signal J1ϕ1. The binary coded signal "0001" as the data "1" which is stored at this address in the display register 231, is supplied to the input ends terminals A1 to A4 of the character pattern generator 24. As a result, the data "0000" for the first row of the character pattern of data "1" is latched in the latch circuit 25. In the same manner, addresses for the second to twelfth positions of the display register 231 are sequentially selected at the timing of the timing signal J1$\phi$1, and data of "." to "1" which are stored in the second to twelfth positions of the display register 231 are sequentially supplied to the input terminals A1 to A4 of the character pattern generator. The data for the first row of the character pattern of the data "." to "1" is supplied to the latch circuit 25. In this manner, the data which is stored in the latch circuit 25 is sequentially converted to serial data and is supplied to the shift register 27 through the transfer gates 261 to 266 which are sequentially rendered conductive. In the same manner as described above, the data for the first row of the character pattern of data "." to "1" which is stored in the latch circuit 25 is sequentially converted to serial data and is supplied to the shift register 27. When the data for the first row of each character pattern of the display data of 12 characters which is stored in the display register 231 is stored in the shift register 27, the carry signal from the second counter 33 is supplied to the 7-scale counter 34 and the AND circuit 35. The timing signal $\phi$A is supplied from the AND circuit 35 to the display buffer register 28. The data which is stored in the shift register 27 is retained in the display buffer register 28. The data which is retained in the display buffer register 28 is supplied to the first electrode driving circuit 29. Further, the first electrode driving circuit 29 supplies the first electrode driving signal to the liquid crystal display section 30, based on the data which is retained in the display buffer register 28. In this case, dots in the row A are not displayed, as shown in FIG. 4B.

In the same manner, at timings of the common signals B' to G' of FIGS. 5R to 5W, data corresponding to the first to twelfth positions of the display register 231 are sequentially read out in synchronism with the timing signal J1$\phi$1. The data for each row among the second to seventh rows of each character pattern is output from the character pattern generator 24 and is written in the display buffer register 28. As a result, the dots in the rows B to G at the liquid crystal display section 30 are displayed. Therefore, the data "1234567890.1" is displayed with the 3×5 dot matrix pattern, accomplishing the display of 12 characters.

In the above embodiment, the slide switch is used for selecting the character patterns which are displayed at the liquid crystal display device 30. However, an enter key or a "set" key may be operated to select a desired character pattern. For example, when a sequential key-in operation of "0", "1" and "SET" keys is performed, the 5×7 dot matrix pattern may be selected. When a sequential key-in operation of "0", "2" and "SET" keys is performed, the 3×5 dot matrix pattern may be selected. Furthermore, in the manufacturing process, instead of the slide switch, switches in which a short circuit is formed with a contact of the PCB (printed circuit board) or with an input terminal of the LSI 12 may be utilized for accomplishing the display at the liquid crystal display section 30.

In the first embodiment as described above, the size of the characters is changed by storing a plurality of character patterns in the character pattern generator 24. However, the mode of the character patterns is not limited to this. For example, a converting means may be incorporated to enlarge or reduce in scale a specific character pattern. The character pattern generator need not store a plurality of character patterns.

Further, in the above embodiment, the 5×7 dot matrix pattern is converted to the 3×5 dot matrix pattern. However, the mode of conversion is not limited to this. The number of dots may be varied as needed.

Also, in the above embodiment, the displayed characters are numbers, but the present invention may be extended to letters, symbols and figures. The present invention is not limited to an electronic portable calculator, but may be extended to electronic translation equipment and electronic memo equipment.

Furthermore, the display device may comprise LEDs, fluorescent display tubes or ECDs instead of liquid crystal display devices.

Figure 8:
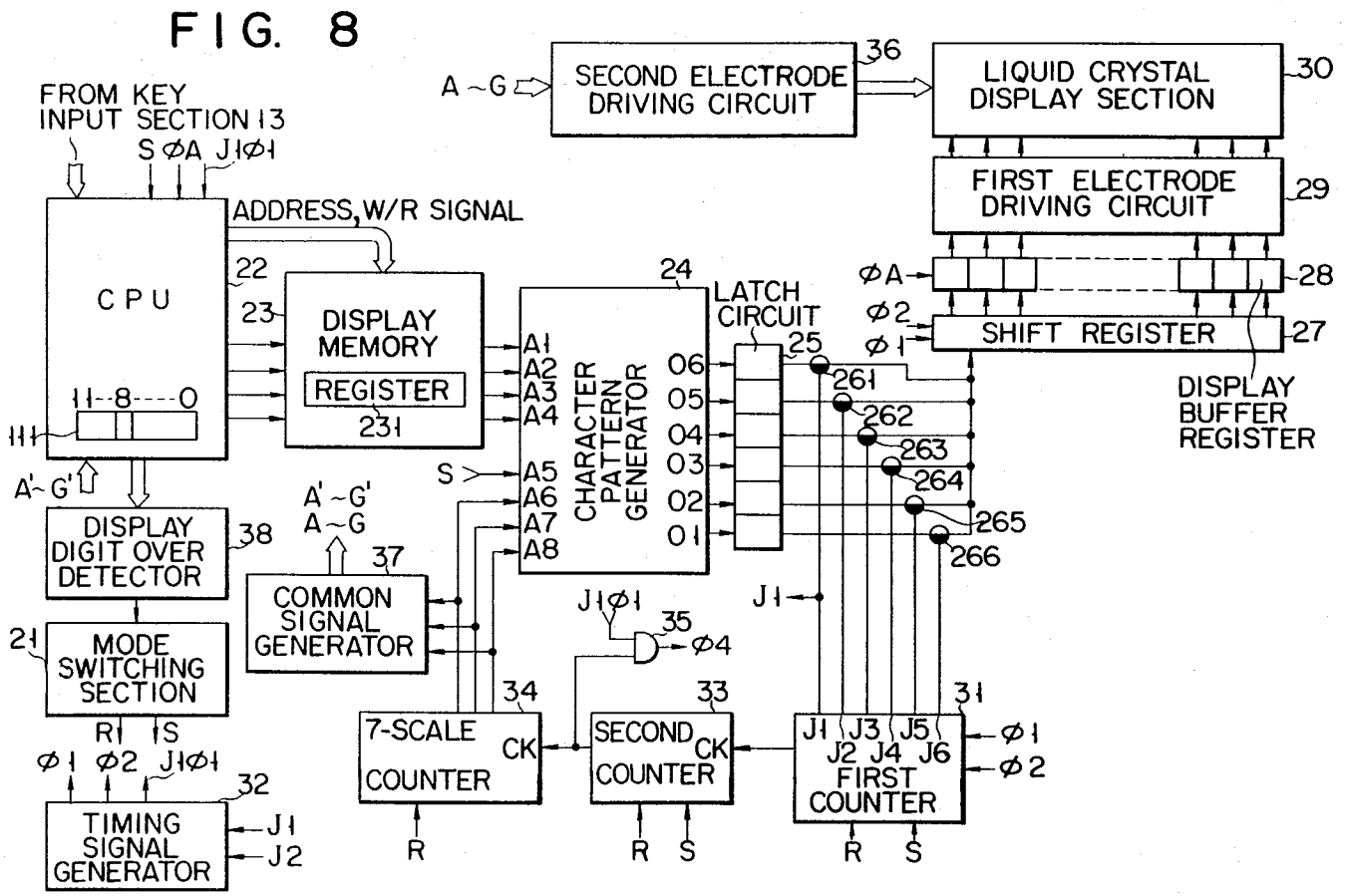
FIG. 8 is a block circuit diagram illustrating the detailed arrangement of an electronic portable calculator according to another embodiment of the present invention.

Another embodiment of the present invention will be described with reference to FIGS. 8 to 12. FIG. 8 shows the overall arrangement of an electronic portable calculator. Data which is entered at the key input section 13 is supplied to the CPU 22. The data which is entered at the key input section 13 or the data which is operated within the CPU 22 based on the above data, is supplied to a display register 111 of 12 character positions within the CPU 22 and to the display register 231 of 12 character positions within the display memory 23, respectively. In each character position of the display register 111, blanking codes are stored except for the character positions in which display data is stored. Therefore, the storage contents of the eighth position of the display register 111 are supplied to an overflow display digit detector 38. The storage contents of the eighth position of the display register 111 are judged in the overflow display digit detector 38 to determine whether or not they are the blanking code. As a result, when the storage contents of the eighth position of the display register 111 are judged to be the blanking code, the signal "0" is supplied to the mode switching section 21. The signal "0" is output as the mode signal S from the mode switching section 21 to each control section. On the other hand, when the storage contents of the eighth position of the display register 111 are judged to be data other than the blanking code, the signal "1" is supplied to the mode switching section 21. The mode switching section 21 then supplies the signal "1" as the mode signal S to each control section. Immediately after the mode signal S is changed from the signal "1" to the signal "0" or from the signal "0" to the signal "1", the reset signal R is supplied to each counter to reset it. The CPU 22 supplies the character address designation signal and the read/write signal to the display register 231. The data of 4 bits which is stored in the position of the display register 231 whose address is accessed by the character address designation signal is input to the input terminals A1 to A4 of the character pattern generator 24. The character pattern generator 24 comprises, for example, a ROM (read-only memory) in which the 5×7 and 3×5 dot matrix patterns are stored. Part of the configuration of the ROM is described with reference to FIGS. 11 and 12. The address designation signal is input through the input terminals A1 to A8 of the character pattern generator 24 to access the data which is stored in the specified address of the display register 231. The input terminal A5 of the character pattern generator 24 receives the mode signal S which is supplied from the mode switching section 21. When the signal "0" as the mode signal S is input to the character pattern generator 24, the 5×7 dot matrix pattern is selected. On the other hand, when the signal "1" as the mode signal S is input to the character pattern generator 24, the 3×5 dot matrix pattern is selected. The data which corresponds to one row of the dot matrix pattern which is stored in the character pattern generator 24 is supplied to the latch circuit 25 of 6 bits through the output terminals O1 to O6. The signal lines carrying signals output from each bit of the latch circuit 25 are connected to the shift register 27 through the transfer gates 261 to 266. The shift register 27 comprises 48 bits, and signal lines therefrom are connected to the display buffer register 28. The data which is retained in the display buffer register 28 is supplied to the first electrode driving circuit 29. Further, the first electrode driving circuit 29 supplies the first electrode driving signal to the liquid crystal display section 30. The signals from the lines "J1" to "J6" of the first counter 31 are output as the gate control signal to the transfer gates 261 to 266. The mode signal S and the reset signal R are output from the mode switching section 21 to the first counter 31. When the first counter 31 receives the signal "0" as the mode signal S, it operates as a 6-scale counter. On the other hand, when the first counter 31 receives the signal "1" as the mode signal S, it operates as a 4-scale of counter. The signals from the lines "J1" and "J2" of the first counter 31 are input to the timing signal generator 32. The carry signal from the first counter 31 is input to the second counter 33. The mode signal S and the reset signal R from the mode switching section 21 are input to the second counter 33. When the second counter 33 receives the signal "0" as the mode signal S, the second counter 33 operates as an 8-scale counter. On the other hand, when the second counter 33 receives the signal "1" as the mode signal S, the second counter 33 operates as a 12-scale counter. The carry signal which is supplied from the second counter 33 is input to the 7-scale counter 34. Further, the carry signal thereof is input to the AND circuit 35. The AND circuit 35 also receives the logical product, that is, the timing signal J1ϕ1. The timing signal ϕA which is output from the AND circuit 35 is supplied as the read-in timing signal to the display buffer register 28 and the CPU 22. The reset signal R from the mode switching section 21 is supplied to the 7-scale counter 34. The counter value of the 7-scale counter 34 is supplied to the input terminals A6 to A8 of the character pattern generator 24 and the common signal generator 37 through three signal lines. The common signals A to G which are supplied from the common signal generator 37 are supplied to the second electrode driving circuit 36. Drive signals are sequentially supplied from the second electrode driving circuit 36 to the rows "A" to "G" of the liquid crystal display section 30. The timing signal generator 32 respectively supplies the clock signals ϕ1 and ϕ2 to the shift register 27 and the first counter 31, and the timing signal J1ϕ1 to the CPU 22.

FIGS. 11 and 12 show the storage condition of part of the ROM which constitutes the character pattern generator 24. FIG. 11 shows the storage pattern of the ROM in which the 5×7 dot matrix pattern is stored. When the signal "0" as the mode signal is supplied to the input terminals A5 of the character pattern generator 24, the data which corresponds to one row of the character pattern stored in the area whose address is accessed by signals input from the input terminals A1 to A4 and A6 to A8, is supplied from the output terminals O1 to O6. In FIG. 11, when the binary coded signals "0001" to "0100" are input from the input terminals A1 to A4, the start address is accessed in which the character pattern of data "1" to "4" is stored. When the binary coded signals "000" to "110" are input from the input terminals A6 to A8, the data of each row of the character pattern of "1" to "4" is supplied from the character pattern generator 24.

FIG. 12 shows the storage condition of the ROM in which the 3×5 dot matrix pattern is stored. When the signal "1" as the mode signal S is supplied to the input terminal A5, the data for one row of the character pattern stored in the area whose address is accessed by the signals which are input from the input terminals A1 to A4 and A6 to A8, is supplied from the output terminals O1 to O6. In FIG. 12, when the binary coded signals "0001" to "0100" are input from the input terminals A1 to A4, the initial address is accessed in which the character pattern of data "1" to "4" is stored. When the binary coded signals "000" to "110" are input from the input terminals A6 to A8, the data for each row of the character pattern of the data "1" to "4" is output.

Figure 9A:
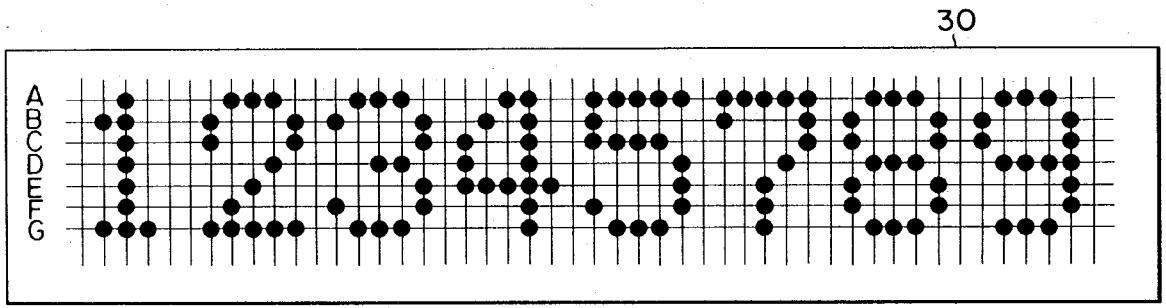
FIGS. 9A and 9B are views for explaining the display conditions in the different display modes, respectively.

The mode of operation of the electronic portable calculator with the above arrangement will be described. The data which is entered at the key input section 13 or the data which is operated within the CPU 22 based on the above data, is stored in the display register 111. When the display data within 8 characters is stored in the display register 111, the blanking code is always stored in the eighth position of the display register 111. Therefore, the signal "0" is supplied from the overflow display digit detector 38 to the mode switching section 21. The reset signal R is then supplied from the mode switching section 21 to the first and second counters 31 and 33 and the 7-scale counter 34, so that the respective counters are reset. The signal "0" as the mode signal S is respectively supplied to the CPU 22, the character pattern generator 24, and the first and second counters 31 and 33. Therefore, the CPU 22 is ready for operations of 8 characters. The data for one row of the 5×7 dot matrix pattern is accessed by the signals which are input from the input terminals A1 to A8 of the character pattern generator 24. The first counter 31 operates as a 6-scale counter and the signal "1" is sequentially output from the lines "J1" to "J6", as shown in FIGS. 10C to 10H. The operation is now described in which the data which is entered at the key input section 13 or the data which is operated within the CPU 22 based on the above data, is supplied as display data "12345789" to the display register 231 and is displayed at the liquid crystal display section 30. At the timing of the common signal A' of FIG. 10Q immediately before the common signal A is output, the address of the first position of the display register 231 is accessed in response to the timing signal J1ϕ1, so that data "9" ("1001") which is stored in this position is supplied to the input terminals A1 to A4 of the character pattern generator 24. As a result, the binary coded data "011100" of the character pattern of the first position of the display register 231 in which the data "9" is stored, is supplied to the latch circuit 25. In the same manner, the second to eighth addresses of the display register 231 are accessed at the timing of the timing signal J1ϕ1, so that the data stored in the second to eighth positions of the display register 231, that is, data "8" to "1", are sequentially supplied to the input terminals A1 to A4 of the character pattern generator 24. The data for the first row of the character pattern which corresponds to the data "9" to "1" is supplied from the character pattern generator 24 and latched in the latch circuit 25. In this manner, the data for the first row of the data "9" which is stored in the latch circuit 25, is sequentially converted to serial data and supplied to the shift register 27 through the transfer gates 261 to 266 which are sequentially rendered conductive. The data for the first row of the character pattern of the data "8" to "1" which are stored in the latch circuit 25 is sequentially converted to serial data and supplied to the shift register 27. The data for the first row of each character pattern of the display data of 8 characters is stored in the shift register 27, and the carry signal from the second counter 33 is supplied to the 7-scale counter 34 and the AND circuit 35. The timing signal $\phi$A is supplied from the AND circuit 35 to the display buffer register 28. The data which is stored in the shift register 27 is retained in the display buffer register 28. The data which is stored in the display buffer register 28 is supplied to the first electrode driving circuit 29. Further, the first electrode driving circuit 29 supplies the first electrode driving signal to the liquid crystal display section 30, based on the data which is retained in the display buffer register 28. As a result, the dots in the row "A" are displayed at the liquid crystal display section 30. When the timing signal $\phi$A is supplied to the CPU 22, signals accessing the addresses of the first to eighth positions of the display register 231 are supplied. In the same manner, at the timing of the common signal B' of FIG. 10R, data for the second position of each character pattern of the display data which is stored in the display register 231 is stored in the shift register 27, so that the dots in the row "B" are displayed as shown in FIG. 9A. At the timings of the common signals C' to G' immediately before the common signals C to G are output, every time the timing signal $\phi$A is supplied to the CPU 22, data for the third to seventh rows of each character pattern of the display data which is stored in the display register 231 is stored in the shift register 27, so that the display data "12345789" of 8 characters is displayed as shown in FIG. 9A.

Figure 9B:
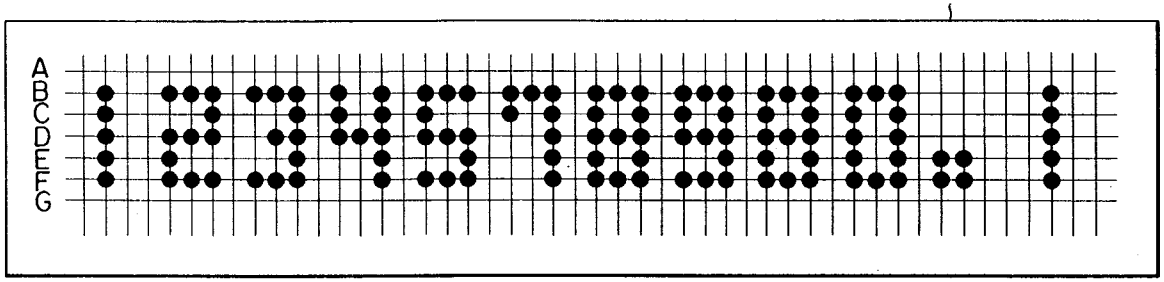
Figure 10:
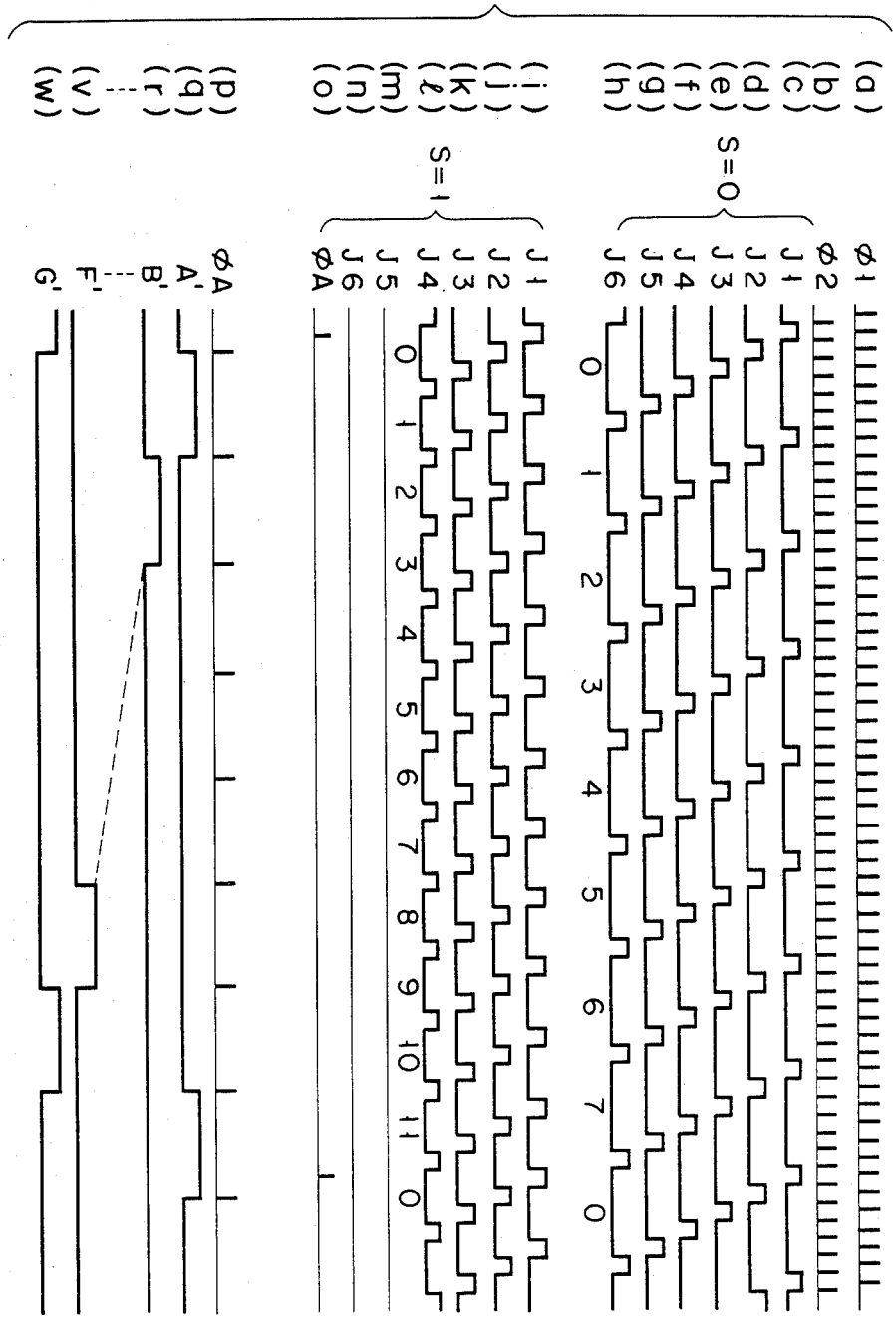
FIG. 10 shows timing charts for explaining the mode of operation of the circuit of FIG. 8.

When the data which is entered at the key input section 13 or the operated result within the CPU 22 based on the input data, is 9 or more characters and is written in the display register 111 within the CPU 22, the signal "1" from the overflow display digit detector 38 is output to the mode switching section 21. As a result, the reset signal R is supplied from the overflow display digit detector 38 to the first and second counters 31 and 33 and the 7-scale counter 34, so that the respective counters are reset. The signal "1" as the mode signal S is supplied from the mode switching section 21 to the CPU 22, the character pattern generator 24, and the first and second counters 31 and 33. Therefore, the CPU 22 is ready for operations of 12 characters. When signals are input from the input terminals A1 to A8 of the character pattern generator 24, data for one row of the 3×5 dot matrix pattern is accessed. The first counter 31 operates as a 4-scale counter and sequentially supplies the signal "1" from the lines "J1" to "J4" of the first counter 31. The signal "0" is always supplied from the lines "J5" and "J6" of the first counter 31. An operation is now described in which data which is entered at the key input section 13 or data which is operated within the CPU 22, based on the input data described above, is input as display data comprising 12 characters, that is, "1234567890.1" to the display register 231 and is displayed at the liquid crystal display section 30. At the timing of the timing signal J1$\phi$1, the address of the first position of the display register 231 is accessed, so that the data "1" ("0001") which is stored therein is supplied from the input terminals A1 to A4 of the character pattern generator 24. As a result, the binary coded data "0000" for the first row of the character pattern of the character data "1" is latched in the latch circuit 25. In the same manner, the addresses of the display register 231 for the second to twelfth rows of the character pattern of the data are accessed at the timing of the timing signal J1$\phi$1, and the data "." to "1" which are stored in the second to twelfth positions of the display register 231 are sequentially supplied to the input terminals A1 to A4 of the character pattern generator 24. The data for the first row of the character pattern of the data "." to "1" is latched in the latch circuit 25. In this manner, the data for the first row of the character pattern which is stored in the latch circuit 25, is sequentially converted to serial data and supplied to the shift register 27 through the transfer gates 261 to 266 which are sequentially rendered conductive. The data for the first row of each character pattern of the display data of 12 characters which is stored in the display register 231, is stored in the shift register 27, and the carry signal from the second counter 33 is supplied to the 7-scale counter 34 and the AND circuit 35. The timing signal $\phi$A is supplied from the AND circuit 35 to the display buffer register 28. The data which is stored in the shift register 27 is retained in the display buffer register 28. The data which is retained in the display buffer register 28 is supplied to the first electrode driving circuit 29. The first electrode driving circuit 29 supplies the first electrode driving signal to the liquid crystal display section 30, based on the data which is retained in the display buffer register 28. In this case, the dots in the row "A" are not displayed, as shown in FIG. 9B. When the timing signal $\phi$A is supplied to the CPU 22 at the timing of the common signal B' of FIG. 10R, signals for specifying the addresses of the first to twelfth positions of the display register 231 are output. In the same manner as described above, at the timing of the common signal B', the data of the second row of the character pattern of the display data which is stored in the display register 231 is stored in the shift register 27, the dots in the row "B" are displayed as shown in FIG. 9B. At the timings of the common signals C' to G', every time the timing signal $\phi$A is sequentially supplied to the CPU 22, data for the third to seventh rows of each character pattern of the display data which is stored in the display register 231 is stored in the shift register 27, so that the display data "1234567890.1" of 12 characters is displayed as shown in FIG. 9B.

In the second embodiment as described above, the size of the characters is changed by storing a plurality of character patterns in the character pattern generator 24. However, the mode of the character pattern is not limited to this. For example, a specific character pattern may be enlarged or reduced. In this manner, a plurality of character patterns need not be used.

Further, in the above embodiment, the 5×7 dot matrix pattern is converted to the 3×5 dot matrix pattern. However, the conversion is not limited to this mode. The number of dots may be varied as needed. Further, in the above embodiment, the displayed characters are numbers, but may be extended to include letters, symbols and figures.

The present invention is not limited to an electronic portable calculator, but may be extended to electronic translation equipment and electronic memo equipment which have a dot matrix display section. Further, the display device may comprise LEDs, fluorescent display tubes or ECDs instead of liquid crystal display devices.

Figure 13:
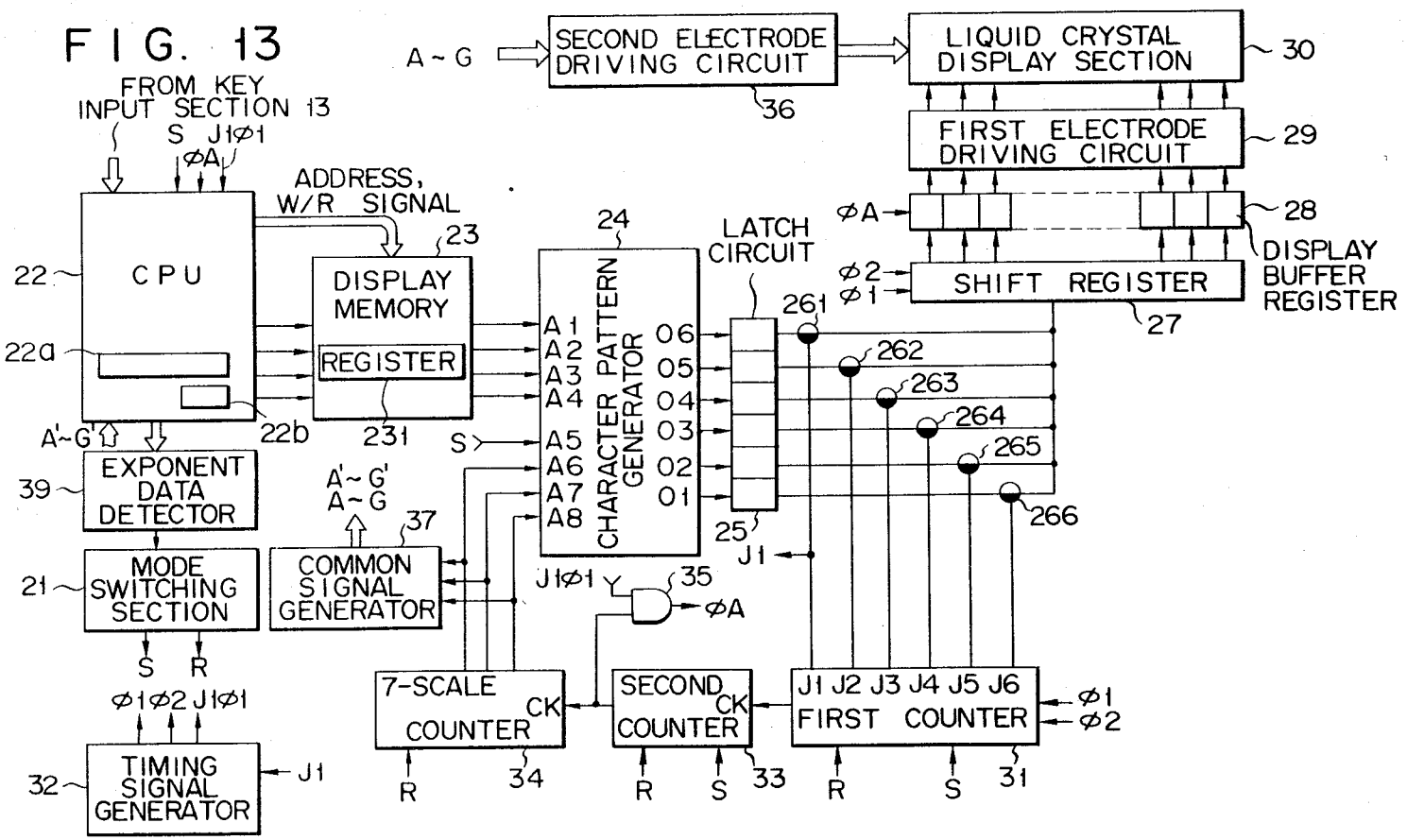
FIG. 13 is a block circuit diagram illustrating the detailed arrangement of an electronic portable calculator according to still another embodiment of the present invention.

Still another embodiment of the present invention will be described with reference with FIGS. 13 to 18 in which the exponent display in an exponent operation exceeds the predetermined number of characters at the display section. As shown in FIG. 13, the data which is entered at the key input section 13 is supplied to the CPU 22. The CPU 22 comprises a significant figure data register 22*a* and an exponent data register 22*b*. The exponent data register 22*b* stores exponent data when the number of characters to be displayed for the significant figure data exceeds the capacity of the number of characters at the display section, or when the exponent data is input with a special key (EXP key). When the exponent data is input to the exponent data register 22*b*, an exponent data detector 39 detects this and a detecting signal is output from the exponent data detector 39 to the mode switching section 21. In response to the detection signal from the exponent data detector 39, the mode switching section 21 supplies the reset signal R and the mode signal S. The mode signal S is supplied to the CPU 22. The significant figure data and the exponent data which are stored in the significant figure data register 22*a* and the exponent data register 22*b* are supplied to the display register 231 of 12 positions. In this case, the CPU 22 supplies the read/write signal and a signal which specifies the character address of the display register 231 to the display memory 23. When exponent data is not stored in the exponent data register 22*b*, the signal "0" as the mode signal S is supplied to the CPU 22 from the mode switching section 21. The significant figure data within the 8 characters which is stored in the significant figure data register 22 is subjected to 8-character control by the CPU 22, so that the CPU 22 accesses an address of the display register 231 in which the significant figure data within 8 characters is stored, and the data is supplied to the display register 231 and stored therein. On the other hand, when the number of characters for the significant figure data exceeds the number of characters to be displayed at the display section, or when exponent data is input with the special key (EXP key) to the exponent data register 22*b*, the signal "1" is supplied from the mode switching section 21 to the CPU 22. Therefore, the control mode of the CPU 22 is changed from the 8-character control mode to the 12-character control mode. The character address designation signal which is to be supplied from the CPU 22 to the display memory 23 is changed, and the exponent data which is stored in the exponent data register 22*b* is stored in the 0th and first positions of the display register 231. The blanking code which is stored in the second and third positions of the display register 231 and the significant figure data which is stored in the significant figure data register 22*a*, are stored in the fourth to eleventh positions of the display register 231. The signal lines of the display memory 23 are connected to the input terminals A1 to A4 of the character pattern generator 24. The display data which is stored in each position of the display register 231 is input to the character pattern generator 24. Part of the configuration of the character pattern generator 24 will be described with reference to FIGS. 17 and 18 later on. The character pattern generator 24 comprises, for example, a ROM (read-only memory). Data for one row of the character pattern which is stored in the area whose address is accessed by signals which are input through the input terminals A1 to A8, is output from the output terminals O1 to O6. The mode signal S which is output from the mode switching section 21 is input to the input terminal A5 of the character pattern generator 24. When the signal "0" as the mode signal S is input, the character pattern of the 5×7 dot matrix pattern is supplied from the character pattern generator 24. On the other hand, when the signal "1" as the mode signal S is input, the character pattern of the 3×5 dot matrix pattern is supplied from the character pattern generator 24. The data for one row of the character pattern which is output from the output terminals O1 to O6 of the character pattern generator 24 is latched in the latch circuit 25. The data for one row of the character pattern which is latched in the latch circuit 25 is sequentially converted to serial data and is stored in the shift register 27 through the transfer gates 261 to 266 which are rendered conductive when the signal "1" is input therein. The data which is stored in the shift register 27 is retained in the display buffer register 28 at the timing of the signal $\phi$A. The data which is retained in the display buffer register 28 is supplied to the first electrode driving circuit 29. The first electrode driving circuit 29 supplies the first electrode driving signal to the liquid crystal display section 30 in response to the data which is retained in the display buffer register 28. The signals from the lines "J1" to "J6" of the first counter 31 are input to the transfer gates 261 to 266. The reset signal R and the mode signal S are input to the first counter 31 from the mode switching section 21. When the signal "0" is input as the mode signal S to the first counter 31, the first counter 31 operates as a 6-scale counter. On the other hand, when the signal "1" is input as the mode signal S to the first counter 31, the first counter 31 operates as a 4-scale counter. Further, the carry signal which is output from the first counter is input to the second counter 33. Then the second counter 33 receives the reset signal R and the mode signal S from the mode switching section 21. When the second counter 33 receives the signal "0" as the mode signal, the second counter 33 operates as an 8-scale counter. On the other hand, when the second counter 33 receives the signal "1" as the mode signal S, the second counter 33 operates as a 12-scale counter. Further, the carry signal which is output from the second counter 33 is supplied to the AND circuit 35. The logical product J1$\phi$1 of the carry signal and the timing signal is supplied to the AND circuit 35. The output signal from the AND circuit 35 is supplied as the timing signal $\phi$A to the CPU 22 and the display buffer register 28. The signals which are output from the three output lines the 7-scale of counter 34 are input to the common signal generator 37. The common signal generator 37 supplies the common signals A to G to the second electrode driving circuit 36 which in turn supplies the second electrode driving signal to the rows "A" to "G" in response to the signals output from the 7-scale counter 34. The relations among the common signals A′ to G′, which are generated immediately before the common signals A to G are generated by the common signal generator 37, and the timing signal $\phi$A which is output from the AND circuit 35, are shown in FIGS. 5P to 5W. The second electrode driving circuit 36 sequentially supplies the second electrode signal to drive the rows "A" to "G" of the liquid crystal display section 30 in response to the common signals A to G which are input to the second electrode driving circuit 36.

FIGS. 17 and 18 show part of the configuration of the character pattern generator 24. FIG. 17 shows the storage condition in which the character pattern of the 5×7 dot matrix is stored. When the signal "0" as the mode signals S is supplied to the input terminal A5 of the character pattern generator 24, the character pattern of the 5×7 dot matrix is output from the character pattern generator 24. FIG. 18 shows the storage condition in which the character pattern of the 3×5 dot matrix is stored. When the signal "1" as the mode signal S is supplied to the input terminal A5 of the character pattern generator 24, the character pattern of the 3×5 dot matrix is output from the character pattern generator 24. The signal from the line "J1" of the first counter 31 is input to the timing signal generator 32. The timing signal generator 32 supplies the clock signals $\phi$1 and $\phi$2 and the timing signal J1$\phi$1 to each control section.

Figure 14A:
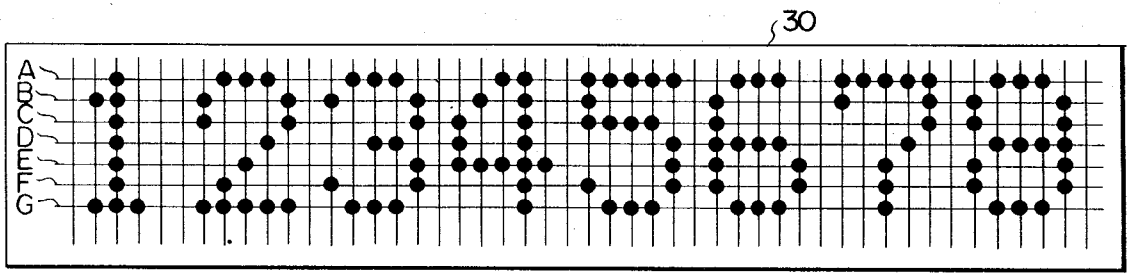
FIGS. 14A and 14B are views for explaining the display conditions in the different display modes, respectively.
Figure 15A:
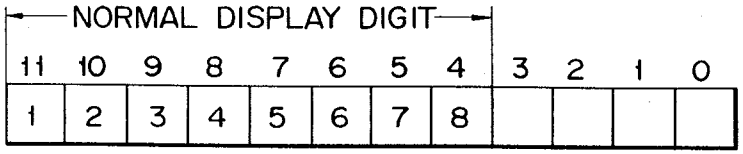
FIGS. 15A and 15B are views for explaining the storage condition when exponent data is stored in a display register of FIG. 13.

The mode of operation of the electronic portable calculator with the above arrangement will now be described. The data which is entered at the key input section 13 or the data which is operated within the CPU 22 based on the input data, is sequentially supplied to the significant figure data register 22*a*, in the same manner as described in the first and second embodiments. When the data which is stored in the significant figure data register 22*a* comprises 8 characters or less, the data which is stored in a predetermined position of the register whose address is accessed is sequentially stored in the display register 231. In this case, since exponent data is not written in the exponent data register 22*b*, the detection signal from the exponent data detector 39 is not output to the mode switching section 21. As a result, the signal "0" as the mode signal S is output from the mode switching section 21. Assume that data comprising 8 characters, that is, data "12345678", is stored in the significant figure data register 22*a*. This data comprising 8 characters is stored in the fourth to eleventh positions of the display register 231, as shown in FIG. 15A. At the timing of the common signal A' of FIG. 16Q, the character address of the display data which is stored in the display register 231 at the timing of the timing signal J1$\phi$1 is accessed. The binary coded signal "1000" which corresponds to the character data "8" which is stored in the fourth position of the display register 231, is input to the character pattern generator 24. The data for the first row of the character pattern of the 5×7 dot matrix, which corresponds to the character data "8" which is stored in the character pattern generator 24, is latched in the latch circuit 25. In this case, the dot signal "01110" which indicates the presence or absence of the dots which constitute the character pattern is latched in the latch circuit 25. The data which is retained in the latch circuit 25 is sequentially stored in the shift register 27 through the transfer gates 261 to 266 which are sequentialy rendered conductive. In the same manner, at the timing of the timing signal J1$\phi$1, the display data which is stored after the fifth position of the display register 231 is sequentially supplied to the character pattern generator 24. At the timing of the signal $\phi$A, the data for one row of the character pattern which corresponds to the display data which is stored in the fourth to eleventh positions of the display register 231 and which is, in turn, stored in the shift register 27 is retained in the display buffer register 28. The dots in the row "A" are displayed at the liquid crystal display section 30, as shown in FIG. 14A. Further, at the timing of the common signal B' of FIG. 16R, the address of the fourth position of the display register 231 is accessed at the timing of the signal $\phi$A, so that the data for the second row of the character pattern which corresponds to the character data "8" to "1" is supplied to the shift register 27. The dots in the row "B" are displayed at the liquid crystal display section 30, as shown in FIG. 14A. In the same manner, at the timing of the common signal C', the address of the fourth position of the display register 231 is accessed by the CPU 22. At the timing of the timing signal J1$\phi$1, the display data which is stored at each position of the display register 231 is supplied to the character pattern generator 24. In the same manner as described above, the data after the third row of the character pattern which corresponds to the display data which is stored in the fourth to eleventh positions of the display register 231 is supplied to the shift register 27. The dots after the row "C" are displayed at the liquid crystal display section 30, as shown in FIG. 14A. In the same manner, the dots in rows "D" to "G" are displayed.

Figure 14B:
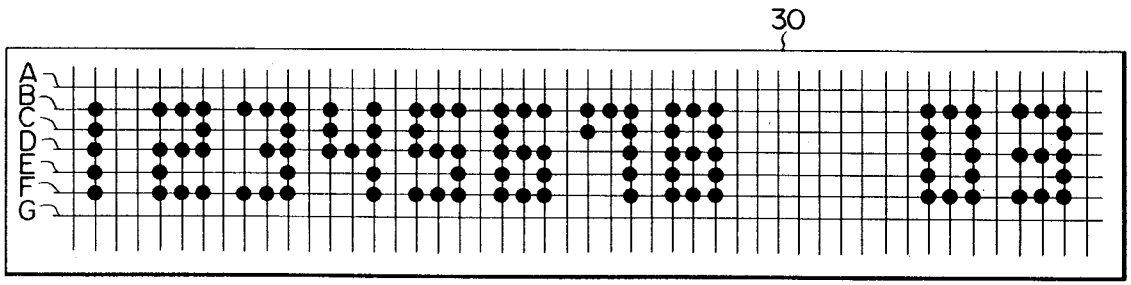
Figure 15B:
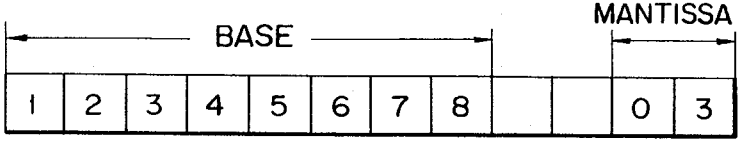
Figure 16:
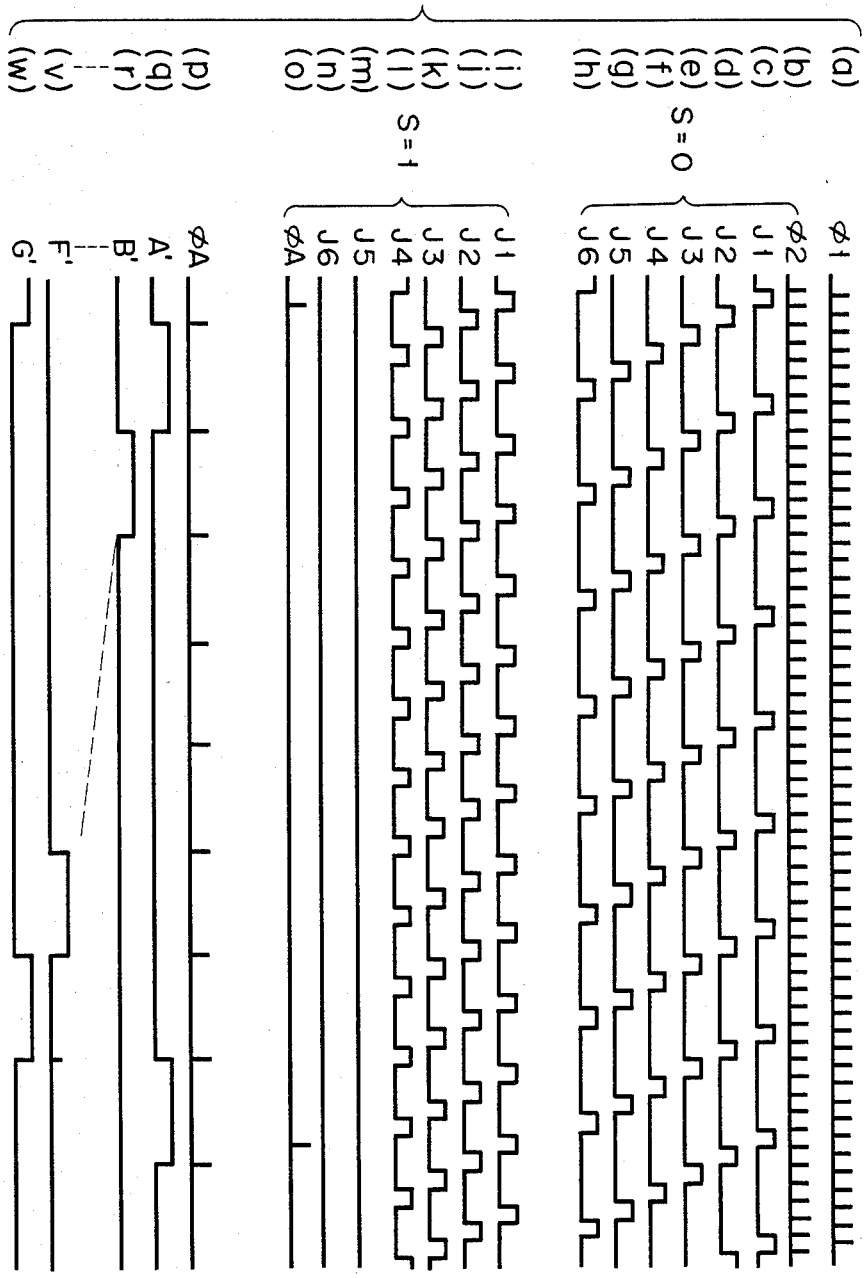
FIG. 16 shows timing charts of the respective signals for explaining the mode of operation of the circuit of FIG. 13.

When the data which is entered at the key input section 13 or the data which is operated within the CPU 22 based on the input data as described above exceeds 8 characters, or when exponent data is input with the special key (EXP key), significant figure data is stored in the significant figure data register 22*a* and exponent data is stored in the exponent data register 22*b*. Therefore, the detection signal from the exponent data detector 39 is supplied to the mode switching section 21. As a result, the reset signal R is supplied from the mode switching section 21 to the first and second counters 31 and 33 and the 7-scale counter 34, so that the respective counters are reset. The signal "1" as the mode signal S is supplied from the mode switching section 21 to each control section. Assume that significant figure data comprising 8 characters, that is, data "12345678", is stored in the significant figure data register 22*a*, and exponent data comprising 2 characters, "03", is stored in the exponent data register 22*b*. The exponent data and the significant figure data are stored in the display register 231 whose address is accessed by the CPU 22, as shown in FIG. 15B. At the timing of the common signal A' of FIG. 16Q, the character address of the data stored in the display register 231 is accessed by the CPU 22 at the timing of the timing signal J1$\phi$1. The binary coded signal "0011" corresponding to the character data "3" which is stored in the 0th position of the display register 231 is transmitted to the character pattern generator 24. The data for the first row of the character pattern of the 3×5 dot matrix, which corresponds to the character data "3" which is stored in the character pattern generator 24, is latched in the latch circuit 25. The data latched in the latch circuit 25 is supplied to the shift register 27 through the transfer gates 261 to 266 which are sequentially rendered conductive. In the same manner, at the timing of the timing signal J1$\phi$1, the display data which is stored after the second position of the display register 231 is supplied to the character pattern generator 24. At the timing of the signal $\phi$A, the data for one row of the character pattern for the display data which is stored in the 0th to eleventh positions of the display register 231, is retained in the display buffer register 28. In this case, since the all "0" data is stored in the display buffer register 28, the dots in the row "A" are not displayed at the liquid crystal display section 30, as shown in FIG. 14B. At the timing of the signal B' shown in FIG. 16R, the addresses of the 0th and subsequent positions of the display register 231 are accessed, and the display data stored therein is supplied to the character pattern generator 24. Further, at the timing of the timing signal J1$\phi$1, the data for the second row of the character pattern of the 3×5 dot matrix which corresponds to the display data stored in each position of the display register 231 is supplied to the shift register 27. At the timing of the clock signal $\phi$1, the data which is stored in the shift register 27 is retained in the display buffer register 28. Therefore, the dots in the row "B" are displayed at the liquid crystal display section 30, as shown in FIG. 14B. In the same manner as described above, at the timing of the clock signal $\phi$1, the address of the 0th position of the display register 231 is accessed by the CPU 22. At the timing of the timing signal J1$\phi$1, the display data which is stored in each position of the display register 231 is supplied to the character pattern generator 24. In the same manner, the data after the third row of the character pattern, which corresponds to the display data which is stored in the 0th to eleventh positions of the display register 231, is supplied to the shift register 27. The dots in the rows "C" to "G" are displayed at the liquid crystal display section 30, as shown in FIG. 14B.

In the third embodiment as described above, the $5\times7$ dot matrix pattern is converted to the $3\times5$ dot matrix pattern. However, the conversion is not limited to this mode. The number of dots may be varied as needed. Further, the display device may comprise LEDs, fluorescent display tubes, or ECDs instead of liquid crystal display devices.

In the above embodiment, the size of the characters is changed by storing a plurality of character patterns in the character pattern generator 24. However, the mode of the character patterns is not limited to this. For example, a specific character pattern may be enlarged or reduced. In this manner, a plurality of character patterns need not be used.

Furthermore, the present invention is not limited to the particular embodiments as described above. Various changes and modifications may be made within the spirit and scope of the present invention.

What is claimed is:

1. Electronic equipment comprising:

memory means for storing input data to be displayed;

character pattern signal generating means including first and second sets of character patterns and coupled to said memory means, for generating a selected one of first and second character pattern signals each corresponding to the input data to be displayed in response to a corresponding mode signal;

display means including a display section in which a plurality of dot display elements are aligned in a matrix form, for displaying the data which is stored in said memory means in response to the selected character pattern signal from said character pattern signal generating means;

mode signal generating means for generating different first and second mode signals in response to a detected display mode of the data to be displayed by said display means; and display control means including selecting means for selecting one of said first and said second character patterns in response to said detected display mode, for displaying the data which is stored in said memory means in n characters in response to the first mode signal which is generated by said mode signal generating means, and for displaying the data which is stored in said memory means in m characters ($n<m$) in response to the second mode signal.

2. Electronic equipment according to claim 1, wherein said mode signal generating means includes a changeover switch which has first and second contacts for providing the first and the second mode signals, wherein corresponding first and second display modes can be switched by an external operation.

3. Electronic equipment according to claim 1, further comprising operation means coupled to said mode signal generating means, said mode signal generating means having overflow detecting means for detecting whether or not data characters entered from outside, or operated results within said operation means based on data characters entered from outside, exceed the capacity of said memory means, said mode signal generating means being set in a first display mode to generate said first mode signal when said overflow detecting means does not detect an overflow condition, and said mode signal generating means being set in a second display mode to generate said second mode signal when the said overflow detecting means detects the overflow condition.

4. Electronic equipment according to claim 1, further comprising operation means for storing data characters entered from outside, or operation results calculated within said operation means based on data characters entered from outside, in significant figure parts and exponent parts, when the data characters entered from outside or the operation results calculated within said operation means based on the data characters entered from outside exceed the number of characters to be displayed at said display means; and mode signal switching means coupled to said operation means and including detecting means for detecting whether or not the display data has the exponent part, said mode signal switching means being operative to cause display of n characters in a first display mode by generating said first mode signal when said detecting means detects that the display data does not have the exponent part, and to cause display of m characters ($n<m$) comprising the significant figure parts and exponent parts in a second display mode by generating said second mode signal when said detecting means detects that the display data has the exponent part.

5. Electronic equipment according to claim 1, wherein said display means is a liquid crystal display device comprising dot matrix display elements.

* * * * *